United States Patent [19]

Zesch et al.

[11] Patent Number: 5,040,473

[45] Date of Patent: Aug. 20, 1991

[54] METHOD OF, AND APPARATUS FOR, PROCESSING TEXTILE MATERIAL WEBS, PARTICULARLY FOR MANUFACTURING QUILTS AND THE LIKE

[75] Inventors: Manfred Zesch, Fussach, Austria; Peter Vogel, Walzenhausen, Switzerland

[73] Assignee: Aktiengesellschaft Adolph Saurer, Arbon, Switzerland

[21] Appl. No.: 545,657

[22] Filed: Jun. 29, 1990

[30] Foreign Application Priority Data

Jul. 3, 1989 [CH] Switzerland ..... 02463/89

[51] Int. Cl.[5] ..... D05B 21/00; D05B 11/00

[52] U.S. Cl. ..... 112/117; 112/118; 112/121.14; 112/121.26; 112/266.1

[58] Field of Search ..... 112/117, 118, 80.3, 112/266.1, 121.14, 121.26; 26/88, 89, 93, 95, 96

[56] References Cited

U.S. PATENT DOCUMENTS

| | | | |
|---|---|---|---|
| 2,236,421 | 3/1941 | Boettcher | 112/118 |
| 2,336,952 | 12/1943 | Olson | 112/117 X |
| 2,501,240 | 3/1950 | Schwartz | 112/118 |
| 3,044,426 | 7/1962 | Schwarzberger | 112/117 |
| 3,354,850 | 11/1967 | Story | 112/118 |
| 3,960,095 | 6/1976 | Story | 112/118 |
| 4,408,552 | 10/1983 | Kondo et al. . | |
| 4,432,296 | 2/1984 | Grondin | 112/80.3 |
| 4,883,009 | 11/1989 | Haselberger et al. . | |

FOREIGN PATENT DOCUMENTS

| | | | |
|---|---|---|---|
| 0136639 | 4/1985 | European Pat. Off. | 112/117 |
| 0316267 | 5/1989 | European Pat. Off. | 112/117 |
| 1550051 | 10/1964 | France | 112/117 |

*Primary Examiner*—Werner H. Schroeder
*Assistant Examiner*—Paul C. Lewis
*Attorney, Agent, or Firm*—Sandler, Greenblum & Bernstein

[57] ABSTRACT

In a quilting machine for quilting or stitching textile formations of cover-material webs and filler-material webs, the material webs to be stitched together are loosely withdrawn from stock rollers and sewn together along lengthwise edges or marginal portions of the material webs prior to entering a tenter device. Sewing the lengthwise edges or marginal portions includes simultaneously sewing on respective bands or ribbons which laterally extend beyond a workpiece to be quilted and serve for holding or accommodating the latter in the tenter device. It is thus possible to substantially provide the entire width of the cover-material webs and filler-material webs with a quilt pattern. In this manner, the length of waste cuttings of expensive cover material is substantially reduced.

18 Claims, 3 Drawing Sheets

METHOD OF, AND APPARATUS FOR, PROCESSING TEXTILE MATERIAL WEBS, PARTICULARLY FOR MANUFACTURING QUILTS AND THE LIKE

BACKGROUND OF THE INVENTION

The present invention broadly relates to a method of, and apparatus for, forming quilts and pertains, more specifically, to a new and improved method of processing textile material webs, especially for the manufacture of quilts, and to a new and improved apparatus for processing textile material webs, particularly for the section-by-section or unit manufacture of multilayer quilts and the like.

Generally speaking, in the practice of the method aspects of the present invention for the processing of textile material webs in a quilting or stitching machine, especially for the manufacture of quilts and the like, cover-material webs and filler-material webs are withdrawn from a material stock or supply, laterally sewn together along lateral lengthwise edges or marginal portions, clamped and stretched section-by-section in a tenter device or frame of the quilting or stitching machine, quilted or stitched in the tenter device or frame and subsequently guided out of the quilting or stitching machine as a quilted workpiece.

As to the apparatus aspects of the present development, the new and improved apparatus concerns a quilting or stitching machine comprising a sewing or stitching device, a feed station provided with a material stock or supply from which cover-material webs and filler-material webs can be withdrawn, and a tenter frame or frame unit guidable back-and-forth or reciprocated relative to the sewing or stitching device, the cover-material webs and the filler-material webs having a predetermined path of conveyance and being stretched and quilted in the tenter frame or frame unit. There are also provided means for leading or withdrawing the quilted material webs out of the quilting machine.

Quilts and the like consist of several layers of flat textile webs, generally of one or several layers formed of cotton or a fiber filling or padding as well as of a top layer of cover material and a bottom layer of cover material. These layers are sewn or stitched together by seams which usually extend in an ornamental pattern or design.

The superposed fabric materials and inserts must be held together during the quilting or stitching operation, so that no mutual shifting or displacement relative to one another can take place. For this purpose, the individual layers are fed to the quilting or stitching machine, stretched in a frame or frame unit or held between pairs of rolls or rollers and thus accurately positioned, before they can be sewn or stitched together in the frame or frame unit or between the pairs of rolls or rollers.

In a quilting machine as known from European Patent Application No. 0,316,267, published May 17, 1989 and the cognate U.S. Pat. No. 4,883,009, granted Nov. 28, 1989, the lengthwise edges or marginal portions of cover-material webs and filler-material webs are sewn together during web withdrawal from stock or supply rolls, so that the loosely superposed material webs not yet stretched in a tenter frame cannot be mutually displaced relative to each other by the longitudinal movements of the tenter frame. This known quilting or stitching machine perfectly precludes slipping or sliding of the still nonquilted material webs or layers.

The disadvantage of this known quilting or stitching machine and, in fact, of all other quilting or stitching machines is the loss or waste of expensive cover and filler material which is held in the tenter frame within the covering range of the clamping jaws or toothed segments along the lengthwise edges or marginal portions and which cannot be quilted and, therefore, has to be cut off as waste.

SUMMARY OF THE INVENTION

Therefore, with the foregoing in mind, it is a primary object of the present invention to provide a new and improved method of, and apparatus for, processing textile material webs, especially for manufacturing quilts and the like and which do not suffer from the aforementioned drawbacks and shortcomings of the prior art.

Another and more specific object of the present invention is directed to providing a new and improved method of, and apparatus for, processing textile material webs and by means of which during continuous section-by-section manufacture of quilts and the like there is substantially precluded a mutual displacement of the individual material webs relative to each other prior to and during the quilting or stitching process, and there is rendered possible essentially loss-free quilting of the entire width of the cover-material and fiber-material webs.

Now in order to implement these and still further objects of the invention, which will become more readily apparent as the description proceeds, the method aspects of this development contemplate, among other things, sewing on a band or ribbon laterally extending beyond the lateral lengthwise edges or marginal portions during the operation of laterally sewing together the cover-material webs and the filler-material webs along the lateral lengthwise edges or marginal portions.

By providing a lateral band or ribbon applied by a seam along each of the two edges or marginal portions of the infed loosely superposed cover-material webs and filler-material webs, it is surprisingly possible, on the one hand, to mutually hold in position the cover-material webs and the filling or padding relative to each other and, on the other hand, to grasp and clamp the section or workpiece to be quilted outside of the lateral lengthwise edges or marginal portions of the cover material.

Simultaneously with the step of laterally sewing together the superposed material webs, the parts or portions located outside the seams are separated or severed by means of cutting devices or cutters disposed upstream or downstream of sewing machines provided for the lateral sewing operation.

The waste or loss of expensive material, particularly costly cover material is considerably reduced, since only a very narrow strip must be severed or separated when the band or ribbon is removed.

The sewn-on bands or ribbons are particularly advantageous also with regard to a firm hold in the clamping means of the tenter device or frame, since no smooth cover material surfaces and unevenly thick filler materials can impair slip-free clamping.

As alluded to above, the invention is not only concerned with the aforementioned method aspects, but also deals with an improved apparatus for processing textile material webs, particularly for the incremental or section-by-section manufacture of multilayer quilts and the like. According to the invention, such quilting apparatus comprises sewing machines arranged between the feed station provided with the material stock or supply and the tenter frame or frame unit and mounted at each lateral side of the predetermined path of conveyance of the cover-material webs and the filler-material webs, the sewing machines serving to join lateral lengthwise edges or marginal portions of the cover-material webs and filler-material webs and to sew on a band or ribbon extending beyond the lateral lengthwise edges or marginal portions by forming seams.

Cutting means or cutters are selectively arranged upstream of, at or downstream of the sewing machines when viewed in the direction of the predetermined path of conveyance, such cutting means or cutters serving to separate the lateral lengthwise edges located outside of the formed seams.

A receiving station is arranged downstream of the tenter frame and two cutting devices are arranged at the upstream inlet of the receiving station when viewed in the direction of the predetermined path of conveyance. These two cutting devices serve to separate the bands or ribbons.

In an advantageous further embodiment of the apparatus constructed according to the invention there are provided two further sewing devices arranged downstream of the tenter frame when viewed in the direction of the predetermined path of conveyance. These two further sewing devices serve to tuck and sew marginal portions of the sewn-on bands or ribbons around the joined lateral lengthwise edges and thus to form enclosing borders.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Describing now the drawings, it is to be understood that to simplify the showing thereof, only enough of the structure of the quilting apparatus or machine for processing textile material webs has been illustrated therein as is needed to enable one skilled in the art to readily understand the underlying principles and concepts of this invention.

Figure 1:
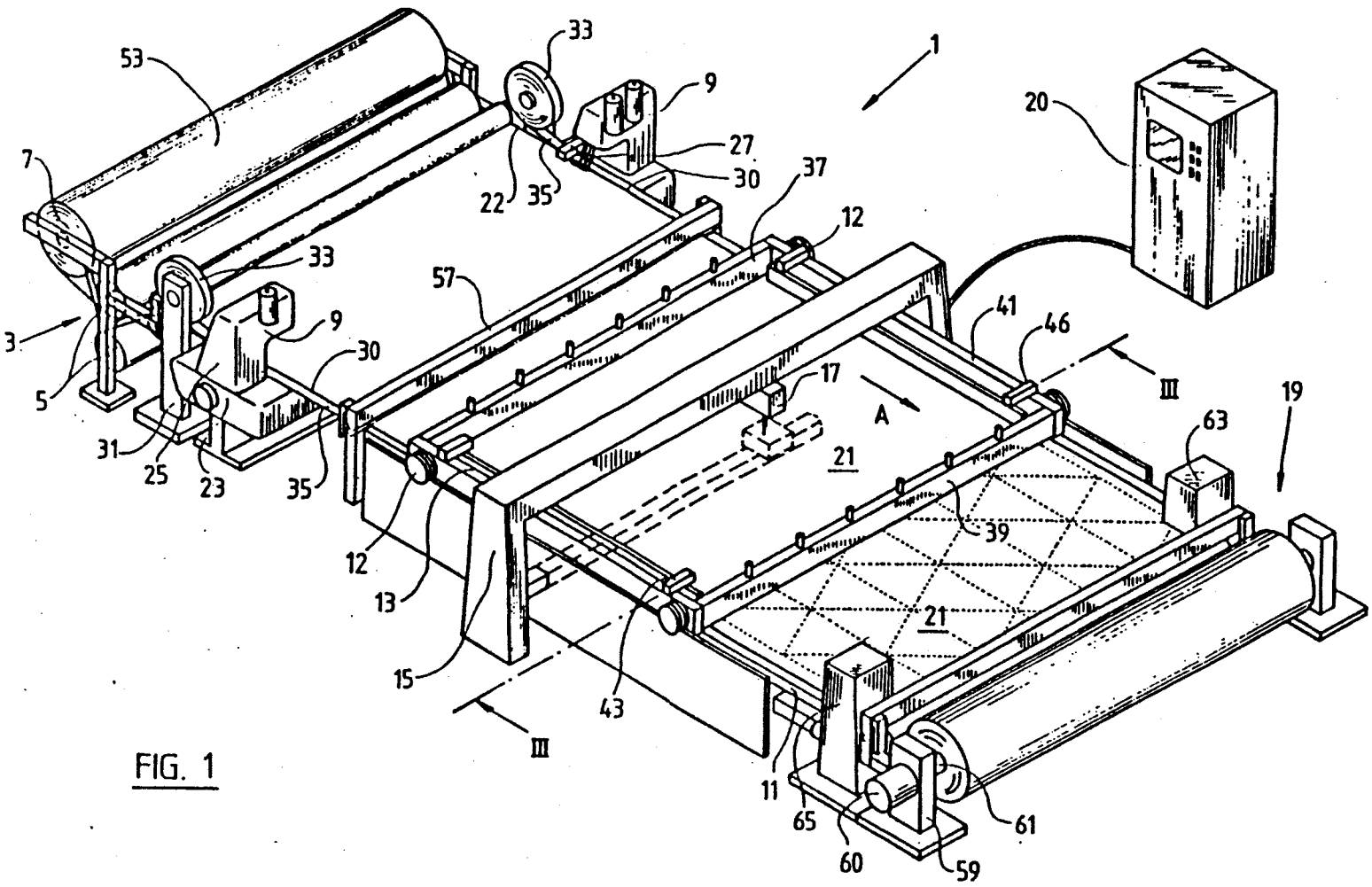
FIG. 1 is a perspective illustration of an exemplary embodiment of the inventive quilting apparatus or machine for the processing of textile material webs and useful for the practice of the method of the present development.

Turning attention now specifically to the exemplary embodiment of quilting apparatus or machine as schematically depicted in FIG. 1 of the drawings and suitable for the performance of the inventive method, the structure illustrated therein by way of example and not limitation will be seen to comprise a quilting or stitching machine 1 for processing textile material webs. This quilting or stitching machine 1 comprises a feed or delivery station 3 equipped with two cover-material rolls or rollers 5 and one or several filler or padding material rolls or rollers 7. At each side of the quilting or stitching machine 1 there is provided a sewing device 9 located downstream of the upstream disposed feed or delivery station 3. There is also provided a bed 11 for accommodating a tenter frame or frame unit 13 movable on rollers 12 along the bed 11. A beam or yoke 15 extends transversely of and bridges the bed 11 and the tenter frame or frame unit 13 from above. At the beam or yoke 15 one or several sewing heads 17 or the like are movably mounted for transverse movement relative to the direction of travel of the tenter frame or frame unit 13.

At the downstream end of the quilting or stitching machine 1 there is arranged a receiving station 19 for the reception or accommodation of a quilted workpiece or work unit 21. This workpiece or work unit 21 can be a quilt, a sleeping bag or, generally speaking, a starting product for ready-made articles or also a technical product which contains, apart from or in addition to flat textile webs, also flat webs of plastic material or metal foils or nettings.

The control of the quilting or stitching machine 1 is effected by a suitable microprocessor which is arranged remote from the quilting or stitching machine 1 and which is accommodated in a housing 20 together with the required operating or control elements. The construction and the mode of operation of the upstream located feed or delivery station 3, the downstream located receiving station 19 as well as the beam or yoke 15 with the sewing head or heads 17 are not subject matter of the present invention and thus shall be hereinafter described only to the extent needed to readily understand the present invention.

Each sewing device 9 is arranged upon a stand or support 23 which can extend across the entire width of the webs of the workpiece or work unit 21 and is located beneath the latter. Two sewing machines 25 structured in a mirror-image relationship or respective forward and rearward moving sewing machines 25 are displaceably mounted at respective stands or supports 23 for transverse movement relative to the material webs of the workpiece or work unit 21.

Figure 2:
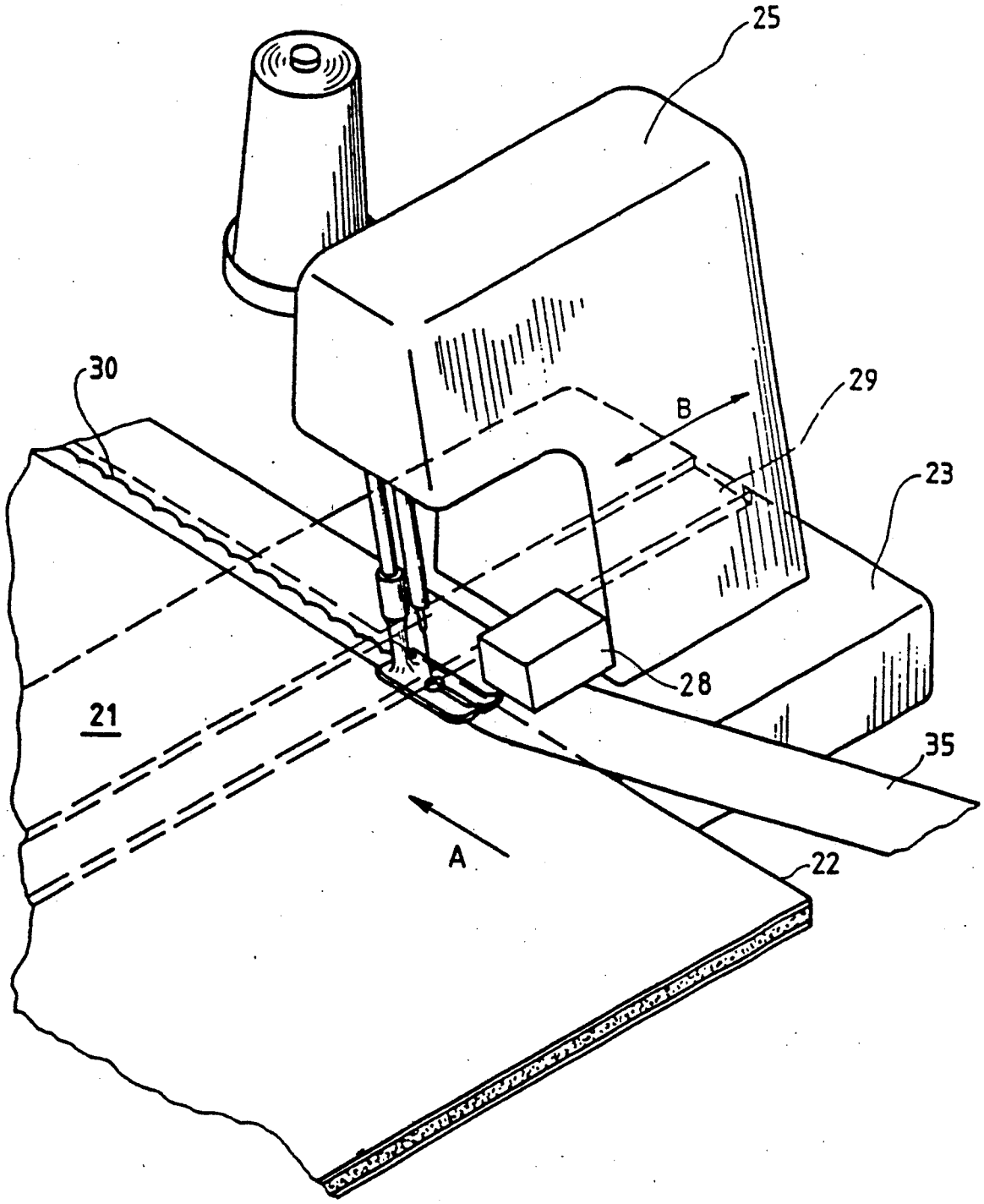
FIG. 2 is a schematic illustration of a sewing station used in the quilting apparatus or machine of FIG. 1.

In FIG. 2 there will be recognized on an enlarged scale the sewing machine 25 arranged on the left side of the quilting or stitching machine 1 illustrated in FIG. 1. Each sewing machine 25 is secured at the lower end thereof to the associated stand or support 23 and can be shifted or displaced in an associated groove or slot 29 defining a guide or on a not particularly illustrated rail or track in the directions of the double-headed arrow B and locked in every desired position, in order that material webs of the workpiece 21 of different or variable width can be processed in the quilting or stitching machine 1.

At the upstream or inlet or entry side of the two sewing machines 25 there are arranged reels or spools 33 at respective stands or supports 31 and having bands or ribbons or tapes 35 wound or coiled thereupon. Band guiding devices 27 guide the bands or ribbons 35 from the reels or spools 33 on to lateral lengthwise edges or marginal portions 22 of the cover-material webs 5, whereby the bands or ribbons 35 only slightly overlap the lateral lengthwise edges or marginal portions 22 to form respective seams 30 which join the bands or ribbons 35 with the material webs 5 and 7. The sewing machines 25 sew together, on the one hand, the bands or ribbons 35 with the cover-material webs 5 and, on the other hand, also the cover-material webs 5 and the filler-material webs 7. The major portion of the sewn-on bands or ribbons 35 project or extend laterally and outwardly beyond the lateral lengthwise edges or marginal portions 22 of the material webs 5 and 7. Cutters or cutting devices 28 serve to separate or sever any irregularly wide portions of the lateral lengthwise edges 22 of the material webs 5 and 7, such edge portions being located outside of the seams 30.

The workpiece or work unit 21 sewn by the two sewing machines 25 and augmented with the bands or ribbons 35 is transported or conveyed in the direction of the arrow A.

Pneumatically or mechanically actuated or operated pairs of clamp or clamping bars or ledges 37 and 39 cooperating in pairs are each mounted at the front or upstream end and at the rear or downstream end of the tenter frame or frame unit 13, when viewed in the direction of workpiece travel or conveyance A. These pairs of clamp or clamping bars 37 and 39 hold the workpiece 21 lying therebetween tightly along a line extending transversely to the direction of workpiece travel or conveyance A. Not particularly illustrated rubber profiles or needles can be provided at the pairs of clamp or clamping bars 37 and 39 for raising or increasing the clamping action or capacity.

Clamping and tenter means 43 and 46 are arranged along lateral supports 41 of the tenter frame or frame unit 13. Such clamping and tenter means 43 and 46 hold and stretch the workpiece or work unit 21 transversely to the direction of workpiece travel or conveyance A. On the one side of the tenter frame 13 as seen at the left in FIG. 3, the clamping and tenter means 43 could be stationarily mounted and function simultaneously as a lateral stop for the associated band or ribbon 35. On the opposite side, the clamping and tenter means 46 are displaceably mounted for transverse movement relative to the direction of workpiece travel or conveyance A.

The clamping and tenter means 43 and 46 are either mutually secured at a suitable stretching beam or individually subjectable to an adjustable force by means of pneumatically or mechanically actuatable piston-and-cylinder units 44 each associated with one of the clamping and tenter means 43 and 46.

Figure 3:
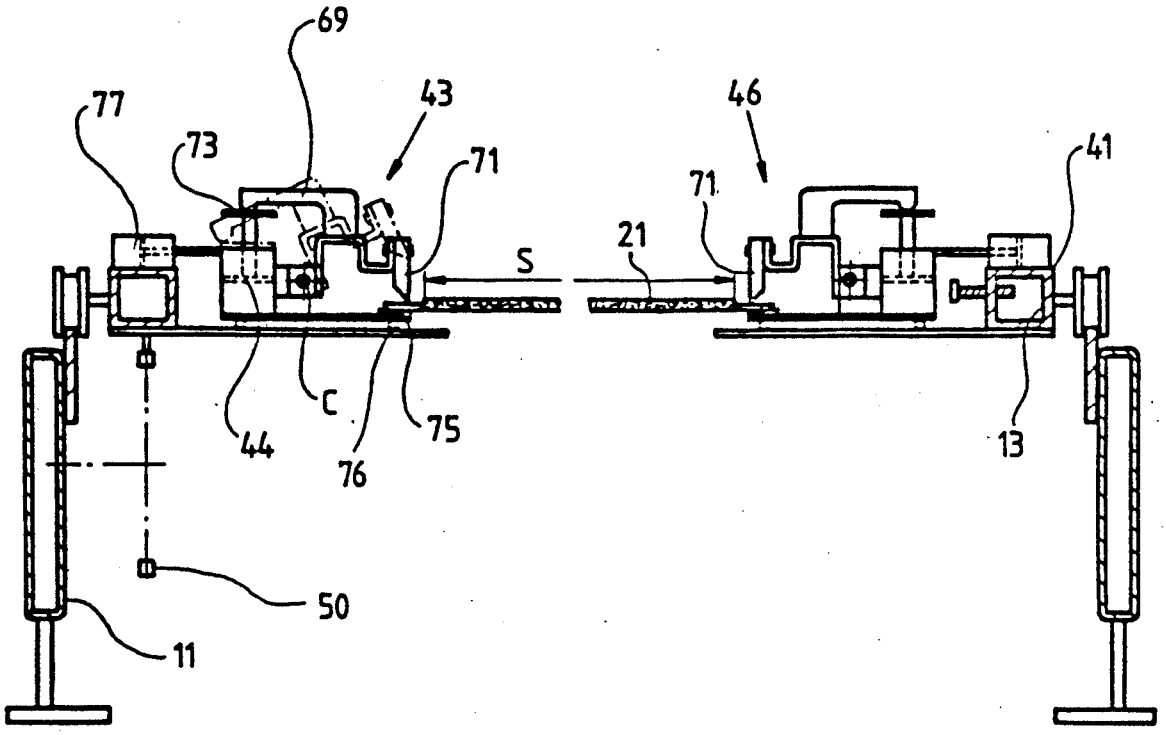
FIG. 3 is a cross-sectional view taken substantially along the line III—III in FIG. 1.

In the embodiment illustrated in FIG. 3, the clamping and tenter means 43 and 46 each comprise a double-armed lever or lever member 69 which is pivotally mounted at the tenter frame or frame unit 13 for movement about an axis C disposed substantially parallel to the direction of workpiece travel or conveyance A. A toothed segment 71 is mounted at the inner or inside located end of the associated double-armed lever or lever member 69. This toothed segment 71 bears upon a guide plate 75. The outer or outside located end of the double-armed lever 69 acts against a piston or piston member 73 of the associated one of the piston-and-cylinder units 44 with which the double-armed lever 69 is pivotable. The double-armed lever 69 and the guide plate 75 are conjointly displaceable on a guide arrangement or guide rollers 76 for transverse movement relative to the direction of travel or conveyance A of the workpiece or work unit 21 by means of a further substantially horizontally disposed pneumatic cylinder 77.

The work surface bounded by the tenter frame or frame unit 13 is devoid of struts or braces traversing or extending across the work surface.

As indicated in FIG. 3, the forward and rearward movements of the tenter frame or frame unit 13 can be effected by a linear drive, for instance a spindle drive, an electronic controlled motor or by a belt or chain drive 50.

The downstream located receiving station 19 for the quilted or stitched workpiece or work unit 21 comprises a stand or support 59 mounted at the bed 11 or standing on the floor. A receiving roll or roller 61 is mounted at this stand or support 59 and is drivable by means of a suitable drive motor 60.

Upstream of the receiving station 19 there can be laterally arranged cutting devices or cutters 63 and 65 by means of which the bands or ribbons 35 extending beyond the workpiece or work unit 21 can be separated or severed. This operation of separating the bands or ribbons 35 by means of rotary knives or any other suitable cutting tools includes cutting either only the bands or ribbons 35 protruding beyond the lateral lengthwise edges or marginal portions 22 or simultaneously also the nonquilted lateral strips of the workpiece or work unit 21. The separated or detached bands or ribbons 35 can be wound and re-used, provided that the remaining width of such separated bands or ribbons 35 is sufficient for reutilization.

On the other hand, the two devices designated by reference numerals 63 and 65 in FIG. 1 and laterally arranged upstream of the receiving station 19 can advantageously constitute two further sewing machines which provide an enclosing border for the workpiece or work unit 21 in that the bands or ribbons 35 protruding beyond the lateral lengthwise edges or marginal portions 22 are tucked around the latter and sewn on thereto.

The steps of the inventive method will be hereinafter described and considered in greater detail:

After withdrawing and bringing together the cover-material webs 5 and the filler-material webs 7, the superposed materials are sewn together, simultaneously with the bands or ribbons 35 delivered from the reels or spools 33, along the lateral lengthwise edges or marginal portions 22 of the cover-material webs 5 by means of the seams 30, e.g. warp stitch seams. There is thus achieved that, on the one hand, the loosely superposed cover-material webs 5 and filler-material webs 7 are held together such that a mutual displacement relative to each other is rendered impossible. On the other hand, the sewn-on bands or ribbons 35 serve for clamping and stretching the material webs 5 and 7 in the tenter frame 13. The clamping and stretching means 43 and 46 acting beyond the cover-material and filler-material webs 5 and 7, particularly the toothed segments 71, render possible processing or quilting the workpiece or work unit 21 approximately up to the lateral lengthwise edges or marginal portions 22 thereof, thus effecting best possible utilization of the generally expensive web material.

Subsequent to the quilting operation the protruding bands or ribbons 35 can be separated or detached by means of the cutting devices or cutter 63 and 65, whereby the portion of the bands or ribbons 35 sewn to the workpiece or work unit 21 can be left thereat until further processing of the quilted workpiece or work unit 21.

While there are shown and described present preferred embodiments of the invention, it is to be distinctly understood that the invention is not limited thereto, but may be otherwise variously embodied and practiced within the scope of the following claims. ACCORDINGLY,

What we claim is:

1. A method of processing textile material webs in a quilting machine, comprising the steps of:

withdrawing cover-material webs and filler-material webs from a material stock;

laterally sewing together the cover-material webs and the filler-material webs along lateral lengthwise edges thereof;

during said step of laterally sewing together the cover-material webs and the filler-material webs, sewing on a band laterally extending beyond the lateral lengthwise edges of the joined cover-material webs and the filler-material webs;

clamping and stretching section-by-section in a tenter frame the cover-material webs and the filler-material webs sewn together with the bands laterally extending beyond the lateral lengthwise edges and thus forming a workpiece;

quilting the cover-material webs and the filler-material webs of the workpiece in the tenter frame; and guiding the quilted workpiece out of the quilting machine.

2. The method as defined in claim 1, wherein:

said step of laterally sewing together the cover-material webs and the filler-material webs and said step of sewing on the band laterally extending beyond the lateral lengthwise edges entail joining the bands and the lateral lengthwise edges to form seams.

3. The method as defined in claim 2, including the step of:

severing sections of cover material and loose filler material located outside of the formed seams.

4. The method as defined in claim 3, wherein:

said step of clamping and stretching section-by-section in the tenter frame the cover-material webs and the filler-material webs sewn together with the bands entails holding and stretching the formed workpiece at the sewn-on bands.

5. The method as defined in claim 4, wherein:

said step of quilting the cover-material webs and the filler-material webs of the workpiece formed in the tenter frame entails providing the workpiece right up to the seams with a quilt pattern.

6. The method as defined in claim 5, further including the step of:

entirely severing the bands prior to winding the quilted workpiece at a receiving station.

7. The method as defined in claim 6, further including the step of:

re-using the bands severed from the lateral lengthwise edges of the quilted workpiece.

8. The method as defined in claim 5, further including the step of:

partially severing the bands prior to winding the quilted workpiece at a receiving station.

9. The method as defined in claim 8, further including the step of:

re-using the bands severed from the lateral lengthwise edges of the quilted workpiece.

10. The method as defined in claim 8, said bands having marginal portions extending beyond respective lateral lengthwise edges of said workpiece, further including the steps of:

subsequent to said step of quilting the workpiece formed in the tenter frame, tucking at least partially said marginal portions of the bands around the lateral lengthwise edges of the workpiece; and sewing the tucked-around portions of the bands as enclosing borders to the workpiece.

11. An apparatus for processing textile material webs, comprising:

a feed station provided with a stock of textile material webs including cover-material webs and filler-material webs;

means for withdrawing said cover-material webs and filler-material webs from said stock of textile material webs to form superposed cover-material webs and filler-material webs having lateral lengthwise edges, said superposed cover-material webs and filler-material webs forming a workpiece;

a sewing device comprising at least one sewing head;

a tenter frame guidable back-and-forth relative to said sewing device and wherein said workpiece of said superposed cover-material webs and filler-material webs is stretched;

said superposed cover-material webs and filler-material webs having a predetermined path of conveyance;

means for providing each of said lateral lengthwise edges with a band extending laterally beyond the associated lateral lengthwise edge;

said sewing device including sewing machines arranged between said feed station and said tenter frame and provided at each lateral side of said predetermined path of conveyance of said workpiece of said superposed cover-material webs and filler-material webs; and said sewing machines serving to join respective lateral lengthwise edges of said superposed cover-material webs and filler-material webs and to sew on said bands extending beyond said respective lateral lengthwise edges to form seams.

12. The apparatus as defined in claim 11, further including:

cutting means arranged upstream of said sewing machines when viewed along said predetermined path of conveyance and serving to separate said lateral lengthwise edges located outside of said formed seams.

13. The apparatus as defined in claim 11, further including:

cutting means arranged in said sewing machines and serving to separate said lateral lengthwise edges located outside of said formed seams.

14. The apparatus as defined in claim 11, further including:

cutting means arranged downstream of said sewing machines when viewed along said predetermined path of conveyance and serving to separate said lateral lengthwise edges located outside of said formed seams.

15. The apparatus as defined in claim 11, further including:

a receiving station having an upstream inlet and arranged downstream of said tenter frame when viewed along said predetermined path of conveyance;

two cutting devices arranged upstream of said upstream inlet of said receiving station when viewed along said predetermined path of conveyance; and said two cutting devices serving the separate said bands.

16. The apparatus as defined in claim 13, further including:

a receiving station having an upstream inlet and arranged downstream of said tenter frame when viewed along said predetermined path of conveyance;

two cutting devices arranged upstream of said upstream inlet of said receiving station when viewed along said predetermined path of conveyance;

said two cutting devices serving to separate said bands.

17. The apparatus as defined in claim 11, further including:

two further sewing devices arranged downstream of said tenter frame when viewed along said predetermined path of conveyance;

said bands having marginal portions extending beyond said joined lateral lengthwise edges of said workpiece; and said two further sewing devices serving to tuck and sew said marginal portions around said joined lateral lengthwise edges of said workpiece and thus forming enclosing borders.

18. The apparatus as defined in claim 13, further including:

two further sewing devices arranged downstream of said tenter frame when viewed along said predetermined path of conveyance;

said bands having marginal portions extending beyond said joined lateral lengthwise edges of said workpiece, and said two further sewing devices serving to tuck and sew said marginal portions around said joined lateral lengthwise edges of said workpiece and thus forming enclosing borders.

* * * * *